US009280100B2

(12) United States Patent
Matsuzaki

(10) Patent No.: US 9,280,100 B2
(45) Date of Patent: Mar. 8, 2016

(54) IMAGE FORMING APPARATUS INCLUDING TRANSFER UNIT

(71) Applicant: CANON FINETECH INC., Misato-shi, Saitama-ken (JP)

(72) Inventor: Kenta Matsuzaki, Noda (JP)

(73) Assignee: Canon Finetech Inc., Misato-shi (JP)

( * ) Notice: Subject to any disclaimer, the term of this patent is extended or adjusted under 35 U.S.C. 154(b) by 0 days.

(21) Appl. No.: 14/580,362

(22) Filed: Dec. 23, 2014

(65) Prior Publication Data

US 2015/0185668 A1 Jul. 2, 2015

(30) Foreign Application Priority Data

Dec. 26, 2013 (JP) ..... 2013-269187

(51) Int. Cl.
*G03G 15/16* (2006.01)
*G03G 15/00* (2006.01)

(52) U.S. Cl.
CPC ..... *G03G 15/1675* (2013.01); *G03G 15/1645* (2013.01); *G03G 15/6532* (2013.01)

(58) Field of Classification Search
CPC ..... G03G 15/1675; G03G 15/1645
See application file for complete search history.

(56) References Cited

U.S. PATENT DOCUMENTS

| | | | | |
|---|---|---|---|---|
| 5,410,393 | A * | 4/1995 | Watanabe | 399/313 |
| 6,334,032 | B1 * | 12/2001 | Tomiki | 399/66 |
| 2007/0258737 | A1 * | 11/2007 | Ogiyama et al. | 399/315 |
| 2009/0129831 | A1 * | 5/2009 | Sakashita et al. | 399/309 |

FOREIGN PATENT DOCUMENTS

JP 05-333704 A 12/1993

* cited by examiner

*Primary Examiner* — Rodney Bonnette
(74) *Attorney, Agent, or Firm* — Fitzpatrick, Cella, Harper & Scinto

(57) ABSTRACT

An image forming apparatus, which is capable of suitably preventing a separating discharge phenomenon from occurring at a fixing entrance guide for guiding a recording material to a fixing device, includes a control portion for controlling a transfer bias voltage and a separation bias voltage. A transfer roller transfers a toner image from a surface of a photosensitive drum onto a sheet at a transfer nip portion, and the control portion changes the transfer bias voltage applied to the transfer roller and the separation bias voltage applied to a charge eliminating needle to have larger voltage values before a trailing edge of the sheet, which is conveyed to the transfer nip portion and is subjected to transfer, passes through the transfer nip portion.

13 Claims, 6 Drawing Sheets

| | VOLTAGE (V) | |
|---|---|---|
| | EMBODIMENT | COMPARATIVE EXAMPLE |
| V1 | 1300 | 1300 |
| V2 | 1700 | 1300 |
| V3 | -1200 | -1200 |
| V4 | -2750 | -1200 |

FIG. 5

| | NECESSITY FOR INSTALLATION SPACE OF COUNTERMEASURE MEMBER | TRANSFER EFFICIENCY | IMAGE QUALITY |
|---|---|---|---|
| EMBODIMENT | ○ | ○ | ○ |
| JP H05-333704 | × | × | ○ |

FIG. 6

| SURFACE RESISTANCE OF SHEET (Ω) | CHARGED AMOUNT OF CONVEY-ANCE GUIDE (V) | EMBODIMENT | | COMPARATIVE EXAMPLE | |
|---|---|---|---|---|---|
| | | CHARGED AMOUNT OF TRAILING EDGE OF SHEET (V) | POTENTIAL DIFFER-ENCE (V) | CHARGED AMOUNT OF TRAILING EDGE OF SHEET (V) | POTENTIAL DIFFER-ENCE (V) |
| $1\times10^{11} \geqq R$ | -800 | -2000 | -1200 | 200 | 1000 |
| $1\times10^{11} > R \geqq 1\times10^{12}$ | -1200 | -2000 | -800 | 200 | 1400 |
| $1\times10^{12} > R \geqq 1\times10^{14}$ | -2000 | -2000 | 0 | 200 | 2200 |
| $R > 1\times10^{14}$ | -2200 | -2000 | 200 | 200 | 2400 |

IMAGE FORMING APPARATUS INCLUDING TRANSFER UNIT

BACKGROUND OF THE INVENTION

1. Field of the Invention

The present invention relates to an image forming apparatus capable of preventing an image defect from occurring due to a separating discharge phenomenon caused by the rubbing between a recording material and a conveyance guide in unfixed toner that has been transferred onto the recording material by a transfer unit.

2. Description of the Related Art

In an image forming apparatus employing an electrophotographic process, such as a copying machine, a printer, and a fax machine, a developing device develops, with toner, an electrostatic latent image obtained by irradiating a uniformly-charged photosensitive member with light based on image information. A toner image is transferred onto a sheet, and then subjected to heating and fixing. Thus, an image is formed.

A guide member, such as a guide, for guiding the sheet from a transfer roller to a fixing device is used. The guide member is brought into contact with the sheet. Therefore, triboelectric charging occurs due to the rubbing between the sheet and the guide member, and a separating discharge phenomenon occurs at a trailing edge portion of the sheet when the sheet is separated from the guide member. Thus, an unfixed toner image on the sheet is disturbed, which causes an image defect in a dotted pattern or the like.

In order to prevent the separating discharge phenomenon, for example, as disclosed in Japanese Patent Application Laid-Open No. H05-333704, an electrode plate may be provided near the member that causes the separating discharge phenomenon to weaken the electric field.

However, in Japanese Patent Application Laid-Open No. H05-333704, when the electrode plate for preventing separating discharge is arranged near a high voltage application member, an application bias voltage of the high voltage application member flows to the electrode plate via the sheet. Therefore, a secondary damage such as insufficient output of the high voltage application member may be caused.

SUMMARY OF THE INVENTION

In order to solve the above-mentioned problem, the present invention provides an image forming apparatus capable of suitably preventing a separating discharge phenomenon from occurring at a fixing entrance guide for guiding a recording material to a fixing device.

In order to achieve the above-mentioned object, according to one embodiment of the present invention, there is provided an image forming apparatus, including: a transfer unit configured to transfer a toner image on an image bearing member onto a recording material which has been conveyed to a transfer region; a transfer bias voltage applying unit configured to apply a transfer bias voltage to the transfer unit; a separating unit configured to cause the recording material to separate from the image bearing member after the toner image is transferred from the image bearing member onto the recording material; a separation bias voltage applying unit configured to apply a separation bias voltage to the separating unit; and a controlling unit configured to change the transfer bias voltage and the separation bias voltage to have larger voltage values before a trailing edge of the recording material passes through the transfer region.

According to another embodiment of the present invention, there is provided an image forming apparatus, including: a potential applying unit configured to apply potential to a recording material after the recording material, onto which a toner image has been transferred, is separated from an image bearing member; a guide at least contacting with the recording material to be guided and guiding the recording material, the guide provided downstream from a region in which the potential is applied, and a controlling unit configured to cause the potential applying unit to apply the potential before a trailing edge of the recording material passes through the region, wherein the controlling unit causes the potential applying unit to apply the potential so that a potential difference between the trailing edge and the guide is set so as to prevent discharge between the trailing edge and the guide.

According to another embodiment of the present invention, there is provided an image forming apparatus, including: a separating unit configured to cause a recording material to separate from a image bearing member after a toner image is transferred from the image bearing member onto the recording material; a separation bias voltage applying unit configured to apply a separation bias voltage to the separating unit; a guide at least contacting with the recording material to be guided and guiding the recording material, the guide provided downstream from a region in which the recording material is separated, and a controlling unit configured to change the separation bias voltage to have larger voltage values before a trailing edge of the recording material passes through the region so that a potential difference between the trailing edge and the guide is set so as to prevent discharge between the trailing edge and the guide.

By preventing the separating discharge phenomenon from occurring at the fixing entrance guide for guiding the recording material to the fixing device, it is possible to obtain a high quality image without an image defect in a dotted pattern or the like.

Further features of the present invention will become apparent from the following description of exemplary embodiments with reference to the attached drawings.

BRIEF DESCRIPTION OF THE DRAWINGS

FIG. 5 illustrates the comparison in effects between the first embodiment and the related art.

FIG. 6 illustrates the relationship between a surface resistance of a recording material and a charged amount of a conveyance guide.

DESCRIPTION OF THE EMBODIMENTS

With reference to the drawings, an image forming apparatus according to each exemplary embodiment of the present invention is specifically described.

First Embodiment

With reference to FIGS. 1 to 5, an image forming apparatus according to a first embodiment of the present invention is described.

<Image Forming Apparatus>

Figure 1:
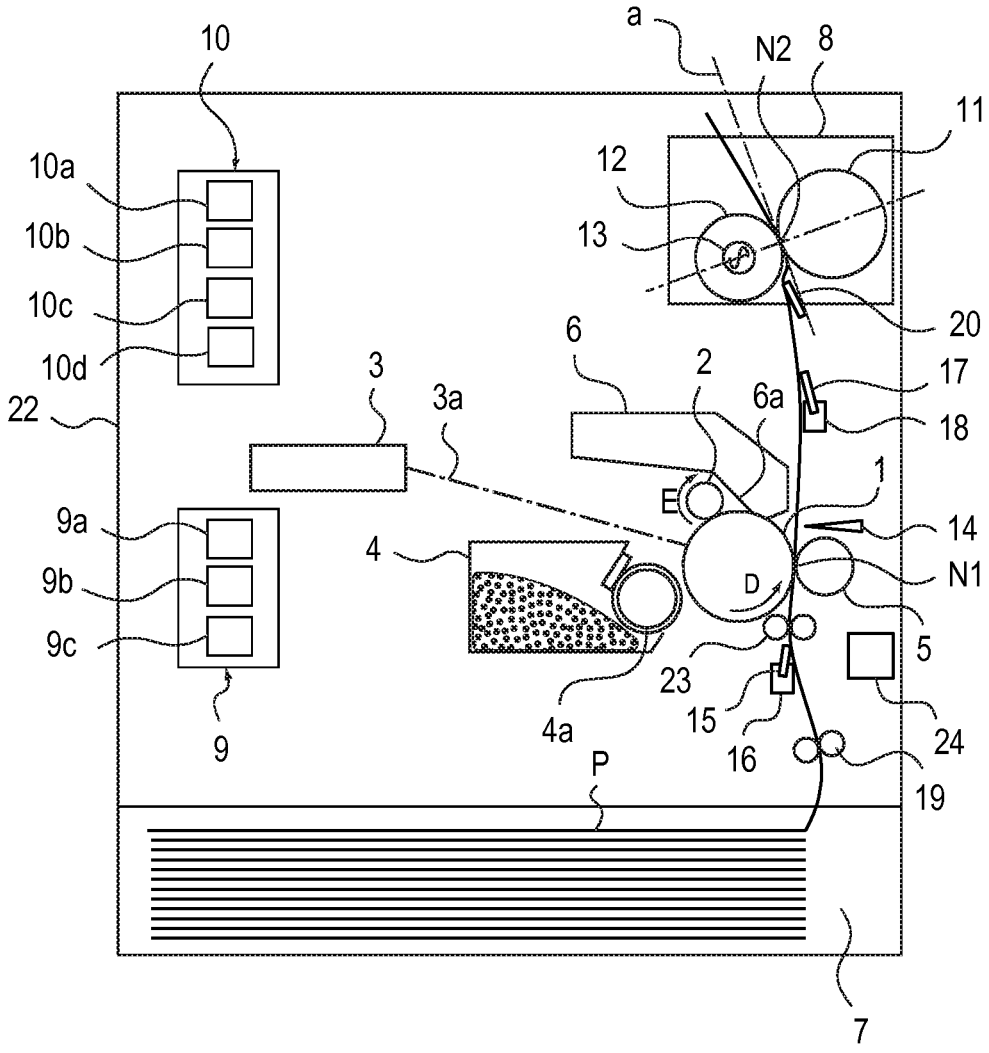
FIG. 1 is an explanatory sectional view illustrating a configuration of an image forming apparatus according to a first embodiment of the present invention.

FIG. 1 illustrates a schematic configuration of the image forming apparatus according to the first embodiment. As an image forming apparatus 22 of the first embodiment, an electrophotographic laser beam printer is described as an example. The image forming apparatus 22 illustrated in FIG. 1 has a photosensitive drum 1 which serves as an image bearing member bearing an electrostatic latent image thereon and which includes a photoconductive layer made of an organic photoconductor (OPC), amorphous silicon (a-Si), or the like.

The photosensitive drum 1 is rotatably supported by a main body of the image forming apparatus 22, and is driven to rotate at a predetermined speed in the arrow D direction of FIG. 1 by a motor (not shown). Around the photosensitive drum 1, a charging roller 2 is provided as a charging unit configured to uniformly charge the surface of the photosensitive drum 1 along the rotational direction of the photosensitive drum 1. A cleaning brush rotary member (not shown) made of pile fabric presses the surface of the charging roller 2 at a predetermined pressure.

The cleaning brush rotary member cleans the surface of the charging roller 2 along with the rotation of the charging roller 2. A cleaning member (not shown) is provided to remove an external additive or toner adhering to the cleaning brush rotary member.

A laser scanner 3 is provided as an image exposure unit configured to irradiate the surface of the photosensitive drum 1, which is uniformly charged by the charging roller 2, with laser light 3*a* based on image information to form an electrostatic latent image. Further, a developing device 4 is provided as a developing unit configured to supply toner serving as developer to the electrostatic latent image, which is formed and borne on the surface of the photosensitive drum 1, to develop the electrostatic latent image as a toner image.

A transfer roller 5 is provided as a transfer unit configured to transfer the toner image formed on the surface of the photosensitive drum 1 (on the image bearing member) onto a sheet P such as paper serving as a recording material (onto the recording material). Further, a cleaning device 6 is provided as a cleaning unit configured to collect the untransferred toner remaining on the surface of the photosensitive drum 1 by a cleaning blade 6*a*.

In a lower part of the main body of the image forming apparatus 22 illustrated in FIG. 1, a feed cassette 7 for receiving the sheets P is arranged. Above the photosensitive drum 1, a fixing device 8 is arranged as a fixing unit configured to fix the toner image having transferred onto the sheet P to the sheet P. The fixing device 8 of the first embodiment includes a fixing film 12 serving as a fixing rotary member, and a pressurizing roller 11 serving as a pressurizing rotary member. A fixing entrance guide 20 is provided so as to guide the sheet P to a fixing nip portion N2 between the fixing film 12 and the pressurizing roller 11.

The fixing entrance guide 20 is provided on the fixing film 12 side (fixing rotary member side) with respect to a nip line "a" between the fixing film 12 and the pressurizing roller 11. The nip line "a" between the fixing film 12 and the pressurizing roller 11 refers to a straight line that passes through the fixing nip portion N2 and is orthogonal to a straight line connecting a rotational center of the fixing film 12 to a rotational center of the pressurizing roller 11.

On the back side of the main body of the image forming apparatus 22, a control portion 9 serving as a controlling unit configured to control an image forming operation or the like, and a high voltage power source 10 for applying a high voltage to the charging roller 2, the developing device 4, and the like are arranged. The control portion 9 includes a main body central processing unit (CPU) 9*a* configured to output a command for executing the image forming operation or the like. The control portion 9 further includes a fixing CPU 9*b* configured to execute temperature control of the fixing device 8 or the like, and a memory 9*c* serving as a memory unit on which an execution program or the like is stored.

The image forming operation of the image forming apparatus 22 is achieved by reading out necessary programs from the respective main body CPU 9*a*, fixing CPU 9*b*, and memory 9*c* of the control portion 9, and executing various controls.

The high voltage power source 10 includes a charging bias power source 10*a* including a DC power source and an AC power source, for applying a charging bias voltage to the charging roller 2. Further, the high voltage power source 10 includes a development bias power source 10*b* including a DC power source and an AC power source, for applying a development bias voltage to a development sleeve 4*a* serving as a developer carrier.

Further, the high voltage power source 10 includes a transfer bias power source 10*c* serving as a transfer bias voltage applying unit including positive and negative DC power sources and being configured to apply, to the transfer roller 5, a transfer bias voltage having a polarity opposite to that of the toner image on the surface of the photosensitive drum 1 (on the image bearing member). The control portion 9 also serves as a transfer bias voltage controlling unit configured to control the transfer bias voltage applied by the transfer bias power source 10*c*.

On the downstream in the conveyance direction of the sheet P in the vicinity of a transfer nip portion N1 between the photosensitive drum 1 and the transfer roller 5, a charge eliminating needle 14 (a potential applying unit) is provided as a separating unit configured to cause the sheet P to separate from the photosensitive drum 1 after the toner image is transferred from the photosensitive drum 1 onto the sheet P. A separation bias voltage having the same polarity as that of the toner image on the photosensitive drum 1 is applied to the charge eliminating needle 14 from a separation bias power source 10*d* serving as a separation bias voltage applying unit. The control portion 9 also serves as a separation bias voltage controlling unit configured to control the separation bias voltage applied by the separation bias power source 10*d*.

Inside the main body of the image forming apparatus 22 (inside the image forming apparatus main body), an environment detecting sensor 24 is provided as an environment detecting unit configured to detect environmental information such as a temperature and humidity inside the main body of the image forming apparatus 22. The memory 9*c* stores the transfer bias voltage to be applied to the transfer roller 5 and the separation bias voltage to be applied to the charge eliminating needle 14, which are set in advance so as to correspond to the environmental information detected by the environment detecting sensor 24.

<Image Forming Operation>

Next, the image forming operation of the image forming apparatus 22 is described in the order of a charging operation, an image exposure operation, a development operation, a transfer operation, a charge eliminating operation, a separation operation, a fixing operation, and a cleaning operation.

<Charging Operation>

In the first embodiment, a contact charging type charging roller 2 is brought into contact at a predetermined pressing force with the surface of the photosensitive drum 1 that is driven to rotate in the arrow D direction of FIG. 1 by the motor (not shown). The charging roller 2 is rotated in accordance with the rotation of the photosensitive drum 1 in the arrow E direction of FIG. 1.

A predetermined DC voltage (DC charging system) is applied as the charging bias voltage from the charging bias power source 10*a* of the high voltage power source 10 through a metal rotary shaft of the charging roller 2 to the charging roller 2. Alternatively, a voltage obtained by superimposing a predetermined DC voltage and a predetermined AC voltage to each other (AC+DC charging system) is applied as the charging bias voltage through the metal rotary shaft of the charging roller 2 to the charging roller 2.

With this, the surface of the photosensitive drum 1 that is driven to rotate at a predetermined speed is uniformly charged through contact to a potential having a predetermined polarity. In the first embodiment, the charging bias voltage is set in a range of from −500 V to −800 V.

The charging roller 2 includes a conductive elastic roller including a roller shaft member formed of a cored bar serving as a conductive support member. Both end portions of the roller shaft member of the charging roller are rotatably supported via bearing members, and the axial line of the roller shaft member is arranged substantially parallel to the drum axial line of the photosensitive drum 1. Thus, the charging roller 2 is arranged in contact with the surface of the photosensitive drum 1 at a predetermined pressing force.

<Exposure Operation>

The surface of the photosensitive drum 1, which is uniformly charged by the charging roller 2, is subjected to image exposure by irradiating the surface with the laser light 3*a* based on the image information by the laser scanner 3 serving as the image exposure unit. Thus, charges at the exposed part are removed to form an electrostatic latent image. In the first embodiment, the image exposure is executed by scanning exposure with a semiconductor laser having a wavelength of 780 nm. Instead of the semiconductor laser, a light emitting diode (LED) array may be used for exposure as long as the system can expose the surface of the photosensitive drum 1.

<Development Operation>

The electrostatic latent image formed on the surface of the photosensitive drum 1 through exposure with the laser scanner 3 is developed by being supplied with toner by the developing device 4. The developing device 4 of the first embodiment includes the development sleeve 4*a* serving as the developer carrier which includes an aluminum roller whose surface is subjected to blasting or carbon coating to have a predetermined surface roughness. A development bias voltage obtained by superimposing a predetermined DC voltage and a predetermined AC voltage to each other (AC+DC charging system) is applied from the development bias power source 10*b* of the high voltage power source 10 to the development sleeve 4*a*, to thereby cause the toner to adhere to the electrostatic latent image on the surface of the photosensitive drum 1 for development (visualization) as a toner image.

The development system of the first embodiment is a one-component reverse jumping development system using a one-component magnetic negative toner. Alternatively, there is a system that carries out development under a state in which the developer is brought into contact with the surface of the photosensitive drum 1 (one-component contact development system). Further alternatively, there is a system that conveys, by an magnetic force, two-component developer obtained by mixing a magnetic carrier into the toner and carries out development under a state in which the developer is brought into contact with the surface of the photosensitive drum 1 (two-component contact development system). Still alternatively, there is a system that carries out development under a state in which two-component developer is not brought into contact with the surface of the photosensitive drum 1 (two-component non-contact development system). Any system can be suitably employed.

<Transfer Operation>

The toner image developed on the surface of the photosensitive drum 1 by the developing device 4 is rotationally moved to a position opposed to the transfer roller 5 by driving the photosensitive drum 1 to rotate. At a synchronized timing, the sheet P received in the feed cassette 7 is fed one by one due to the cooperated action between the separating unit and a feeding roller (not shown). The sheet P is conveyed by conveyance rollers 19 and detected by a registration sensor 16, and then the leading edge thereof is brought into abutment against the nip portion of temporarily-stopped registration rollers 23 to correct the skew of the sheet. At a predetermined timing, the sheet P is nipped and conveyed by the registration rollers 23, and then the sheet P is conveyed to the transfer nip portion N1 between the photosensitive drum 1 and the transfer roller 5.

At a timing when the sheet P is conveyed to the transfer nip portion N1, a predetermined DC voltage having a polarity opposite to that of the developer is applied from the transfer bias power source 10*c* of the high voltage power source 10 to the transfer roller 5. With this, the toner image adhering to the surface of the photosensitive drum 1 is electrostatically transferred onto the sheet P sequentially. In the first embodiment, the toner has a negative polarity, and hence a DC voltage (+2 kV) having a positive polarity (first polarity) corresponding to the polarity opposite to that of the toner is applied to the transfer roller 5.

The first embodiment employs a contact transfer roller system in which the transfer roller 5 is brought into contact with the photosensitive drum 1. Alternatively, a non-contact corona discharge transfer system may be employed in which a high voltage of from 20 kV to 30 kV is applied to a tungsten or metal wire for discharge. Further alternatively, an intermediate transfer belt system may be employed in which a toner image is transferred onto a transfer belt serving as an intermediate transfer belt (ITB), and then the toner image is transferred onto the sheet P.

<Charge Eliminating Operation>

Immediately after the toner image on the surface of the photosensitive drum 1 is electrostatically transferred onto the sheet P by the transfer roller 5, the sheet P is strongly charged by being applied with a high voltage. In the first embodiment, a DC voltage (+2 kV) having a positive polarity is applied to the transfer roller 5 as the transfer bias voltage, and hence the sheet P is charged to have a positive polarity. At this time, the surface of the photosensitive drum 1 is uniformly charged to a polarity opposite to that of the DC voltage applied from the transfer roller 5.

Therefore, an electrostatic adsorption force acts to attract the sheet P to the surface of the photosensitive drum 1. In order to remove the electrostatic adsorption force generated between the sheet P and the photosensitive drum 1, the separation bias voltage, which has a polarity opposite to that of the transfer bias voltage (DC voltage (+2 kV) having a positive polarity) applied to the transfer roller 5, is applied to the charge eliminating needle 14. In the first embodiment, the transfer bias voltage applied to the transfer roller 5 has a positive polarity (first polarity), and hence a DC voltage (−1,300 V) having a negative polarity corresponding to the polarity opposite to that of the transfer bias voltage is applied to the charge eliminating needle 14. With this, the charge of the sheet P due to transfer at the transfer nip portion N1 is eliminated sequentially, and the photosensitive drum 1 and the sheet P are electrostatically separated from each other.

<Conveyance Guide>

The fixing entrance guide 20 serving as a conveyance guide is arranged on the upstream in the conveyance direction of the sheet P serving as the recording material with respect to the fixing nip portion N2 of the fixing device 8 of FIG. 1. In the first embodiment, the fixing entrance guide 20 is configured as follows. That is, the fixing entrance guide 20 is made mainly of polybutylene terephthalate (PBT). Polybutylene terephthalate is a main component of a low resistance member excellent in heat resistance. The fixing entrance guide 20 is placed on the fixing film 12 side (left side of FIG. 1) with respect to the nip line "a" that passes through the fixing nip portion N2 between the fixing film 12 and the pressurizing roller of the fixing device 8 and is perpendicular to a straight line connecting between the rotational centers of the fixing film 12 and the pressurizing roller 11.

With this, the fixing entrance guide 20 functions to guide the sheet P to the fixing nip portion N2 of the fixing device 8. By conveying the sheet P to the fixing nip portion N2 from the fixing film 12 side, the sheet P is preheated before reaching the fixing nip portion N2. With this, the fixing entrance guide 20 may function to suppress a fixing explosion phenomenon or to improve the fixing performance.

The fixing explosion phenomenon refers to a phenomenon that occurs at the lower end of the line drawing portion perpendicular to the conveyance direction of the sheet P. The toner image transferred onto the sheet P receives a vertical pressure of the fixing device 8 to complete the fixing process. Before that, the moisture contained in the sheet P such as paper vaporizes by the heat of the fixing device 8. Then, the toner image may be disturbed by the air pressure, which is thought to cause the fixing explosion phenomenon.

When the fixing entrance guide 20 is placed close to the fixing film 12 in order to suppress the fixing explosion phenomenon or to improve the fixing performance, the fixing entrance guide 20 is susceptible to the ambient temperature caused by the heating temperature of the fixing film 12. As a result, as the fixing entrance guide 20 is placed closer to the fixing film 12 in order to suppress the fixing explosion phenomenon or to improve the fixing performance, toner adhesion remarkably occurs at the leading end portion of the fixing entrance guide 20 on the downstream side in the conveyance direction of the sheet P. Further, the fluttering of the sheet P increases when the trailing edge portion of the sheet P passes beyond the fixing entrance guide 20.

The image defect in a dotted pattern or the like due to the separating discharge phenomenon mainly occurs when the fixing entrance guide 20 is charged to a negative polarity. Therefore, for example, the fixing entrance guide 20 may be changed to a member to be charged to a positive polarity. Even in this case, however, the toner adheres to the leading end portion of the fixing entrance guide 20 on the downstream side in the conveyance direction of the sheet P. Then, the toner adhering portion of the fixing entrance guide 20 is rubbed against the sheet P to charge the toner adhering portion to a negative polarity. Therefore, it cannot be an effective measure to prevent the image defect in a dotted pattern or the like due to the separating discharge phenomenon.

As the current market trend, the image forming apparatus 22 using low-melting-point toner has been developed. In view of this, it is predicted that more toner adhesion occurs at the leading end portion of the fixing entrance guide 20, and the frequency of the image defect in a dotted pattern or the like due to the separating discharge phenomenon tends to increase in the future.

In the first embodiment, PBT serving as a low resistance member is used as a material for the fixing entrance guide 20. Instead, as a resin material to be used as a base, a polyimide resin, a polyamide-imide resin, a fluorine-based resin, or a vinyl chloride-vinyl acetate copolymer can be applied. Further, polycarbonate (PC) or polyethylene terephthalate (PET) can be applied. Still further, a vinyl chloride-based resin can be applied.

Still further, an ABS resin (acrylonitrile-butadiene-styrene copolymer synthetic resin) can be applied. Still further, polymethyl methacrylate (PMMA), a polyester resin such as polybutylene terephthalate (PBT), polyamide (PA), or the like can be applied.

Those materials may be used alone or in combination of two or more kinds. Of those, two or more materials including polycarbonate (PC) excellent in durability and having flame resistance are suitably used, but any material may be suitably used.

<Fixing Operation>

With reference to FIG. 1, the configuration of the fixing device 8 is described. A loop amount of the sheet P having the toner image electrostatically transferred thereon from the surface of the photosensitive drum 1 is detected by a loop amount detecting sensor 18, and then the sheet P is conveyed to the fixing nip portion N2 of the fixing device 8 along the fixing entrance guide 20 illustrated in FIG. 1.

The fixing device 8 includes the tubular fixing film 12 rotatably provided in sliding contact with the outer peripheral surface of a stay holder, and the pressurizing roller 11. The pressurizing roller 11 is driven to rotate by a motor (not shown). The fixing film is rotated in accordance with the rotation of the pressurizing roller 11. The stay holder includes a heater 13 serving as a heat generator including a resistor and alumina substrate, for heating the sheet P having the toner image borne thereon.

The fixing film 12 is formed of a polyimide film having a thickness of 40 μm to 100 μm with its surface layer coated with tetrafluoroethylene-perfluoroalkylvinylether copolymer (PFA). Alternatively, the fixing film 12 is formed of a polyimide film having a thickness of 40 μm to 100 μm with its surface layer coated with polytetrafluoroethylene (PTFE).

The pressurizing roller 11 is formed of an elastic member, and is formed by providing, on a rotatable metal shaft member, a sponge rubber layer serving as a base layer formed of foamed ethylene-propylene-diene copolymer (EPDM) rubber, foamed silicone rubber, or foamed fluororubber. Further, the pressurizing roller 11 includes a surface layer made of silicone rubber, fluororubber, or a resin having heat resistance such as a fluororesin.

When the image forming apparatus 22 receives a print signal, the fixing CPU 9*b* instructs the heater 13 to increase the temperature to a predetermined temperature, and the fixing CPU 9*b* energizes the heater 13 until a thermistor serving as a temperature detecting unit (not shown) detects the predetermined temperature. With this, heating is carried out at the fixing nip portion N2 to fix the toner to the sheet P, and then the sheet P is delivered onto a delivery tray (not shown) provided outside the apparatus. In the first embodiment, an on-demand fixing system is employed. However, the present invention is not limited thereto, and a heat roller system or an electromagnetic induction heating system may be employed as long as the system can fix the toner to the sheet P.

<Cleaning Operation>

As illustrated in FIG. 1, in the photosensitive drum 1 after the toner image is transferred onto the sheet P, toner remaining on the surface of the photosensitive drum 1 without being transferred onto the sheet P is removed by the cleaning blade 6*a* of the cleaning device 6. The waste toner collected into the cleaning device 6 is discharged outside the apparatus by a conveyance screw (not shown) to be conveyed into a collection toner box (not shown). In the first embodiment, the cleaning device 6 includes the cleaning blade 6*a* using the casting type blade.

The above-mentioned operations are repeated to sequentially perform image formation.

<Sheet Detecting Unit>

Next, with reference to FIG. 1, the registration sensor 16 serving as the sheet detecting unit configured to detect the leading and trailing edge positions of the sheet P is described. Further, the loop amount detecting sensor 18 configured to detect the attitude of the sheet P from the transfer nip portion N1 between the photosensitive drum 1 and the transfer roller 5 to the fixing nip portion N2 between the fixing film 12 and the pressurizing roller 11 is described.

<Sheet Detecting Sensor>

As illustrated in FIG. 1, the sheet P fed by the feeding roller (not shown) from the feed cassette 7 is conveyed further downstream by the conveyance rollers 19. The sheet P conveyed downstream abuts against a back surface of a registration sensor flag 15. Then, the sheet P causes the registration sensor flag 15 to rotate in a counterclockwise direction of FIG. 1 about a rotation center (not shown) against a biasing force of a registration sensor spring (not shown), and is further conveyed to the registration rollers 23 on the downstream without being buckled.

As the conveyance of the sheet P proceeds, the leading end portion of the registration sensor flag 15 is rotated in the counterclockwise direction of FIG. 1 about the rotation center (not shown) to be pressed down. Along therewith, a light blocking portion provided on the opposite side to the leading end portion with respect to the rotation center blocks the optical path of light emitting diode (LED) light of the registration sensor 16 formed of a photointerrupter. With this, the registration sensor 16 detects that the conveyed sheet P has arrived, that is, detects the leading edge of the sheet P.

The leading edge of the sheet P still pressing down the registration sensor flag 15 abuts against the nip portion between the stopped registration rollers 23, to thereby form a loop by its own stiffness. After that, the registration rollers 23 are driven to rotate at a predetermined timing to nip and convey the sheet P so that the sheet P is conveyed to the transfer nip portion N1 between the photosensitive drum 1 and the transfer roller 5. After that, as the trailing edge of the sheet P starts to pass beyond the registration sensor flag 15, the registration sensor flag 15 is returned to a predetermined home position by the biasing force of the registration sensor spring (not shown), and waits for the next conveyance of the sheet P.

With this, the registration sensor 16 serving as the sheet detecting unit can detect the timing at which the trailing edge of the sheet P is positioned on the upstream of the transfer nip portion N1 between the photosensitive drum 1 and the transfer roller 5.

In the first embodiment, the registration sensor 16 formed of the photointerrupter is used. Alternatively, a regressive reflection type photosensor (OHT sensor) system may be employed as long as the system can detect or determine the trailing edge of the sheet P. Further alternatively, a control system of predicting the timing from the feed start of the sheet P based on the conveyance speed of the sheet P by a convey unit, or a system of detecting whether or not the sheet P exists at the transfer nip portion N1 between the photosensitive drum 1 and the transfer roller 5 based on the resistance variation of the transfer roller 5 may be employed.

<Loop Amount Detecting Sensor>

The first embodiment employs an on-demand fixing system. Therefore, the fixing film 12 is rotated in accordance with the rotation of the pressurizing roller 11. Therefore, the behavior of the sheet P needs to be controlled regardless of the expansion of the pressurizing roller 11. A loop control operation for the sheet P performed by a loop sensor flag 17 of the loop amount detecting sensor 18 is described.

The loop control for the sheet P starts when the sheet P presses the loop sensor flag 17 of the loop amount detecting sensor 18. The loop sensor flag 17 swings about a rotation center (not shown) so as to follow the loop formed in the sheet P when the sheet P passes across the loop amount detecting sensor 18. Then, a light blocking portion on the opposite side to the leading end portion of the loop sensor flag 17 with respect to the rotation center (not shown) switches the optical path of the LED light of the loop amount detecting sensor 18 formed of a photointerrupter from a blocking state to a transmitting state. With this, the loop amount detecting sensor 18 is switched from an OFF state to an ON state.

When the sheet P enters the fixing nip portion N2 of the fixing device 8, the conveyance speed of the sheet P that is nipped and conveyed by the pressurizing roller 11 and the fixing film 12 of the fixing device 8 is 105 mm/sec. On the other hand, the conveyance speed of the sheet P that is nipped and conveyed by the photosensitive drum 1 and the transfer roller 5 is set to 110 mm/sec, and hence the conveyance speed of the sheet P that is nipped and conveyed by the pressurizing roller 11 and the fixing film 12 of the fixing device 8 is set slower.

Therefore, the loop of the sheet P formed between the transfer nip portion N1 between the photosensitive drum 1 and the transfer roller 5 and the fixing nip portion N2 of the fixing device 8 gradually increases. When the ON state of the loop amount detecting sensor 18 continues for 50 msec, the conveyance speed of the sheet P that is nipped and conveyed by the pressurizing roller 11 and the fixing film 12 of the fixing device 8 is switched as follows. That is, the conveyance speed is switched to 120 mm/sec, which is faster than 110 mm/sec corresponding to the conveyance speed of the sheet P that is nipped and conveyed by the photosensitive drum 1 and the transfer roller 5.

With this, the loop of the sheet P formed between the transfer nip portion N1 between the photosensitive drum 1 and the transfer roller 5 and the fixing nip portion N2 of the fixing device 8 gradually decreases.

As the loop of the sheet P gradually decreases, in response to the swing of the loop sensor flag 17 that swings so as to follow the loop of the sheet P, the loop amount detecting sensor 18 switches from the ON state to the OFF state.

When the OFF state of the loop amount detecting sensor 18 continues for 50 msec, the conveyance speed of the sheet P that is nipped and conveyed by the pressurizing roller 11 and the fixing film 12 of the fixing device 8 is switched as follows. That is, the conveyance speed is switched to 100 mm/sec, which is slower than 110 mm/sec corresponding to the conveyance speed of the sheet P that is nipped and conveyed by the photosensitive drum 1 and the transfer roller 5.

With this, the loop of the sheet P formed between the transfer nip portion N1 between the photosensitive drum 1 and the transfer roller 5 and the fixing nip portion N2 of the fixing device 8 gradually increases.

By repeating the above-mentioned operation, the loop of the sheet P can be maintained within a certain range. Then, when the trailing edge of the sheet P passes beyond the transfer nip portion N1 between the photosensitive drum 1 and the transfer roller 5, and the sheet P passes across the loop amount detecting sensor 18, the loop amount detecting sensor 18 cannot detect the loop of the sheet P, and the fixing device 8 conveys and delivers the sheet P at a certain speed.

The first embodiment employs a system of controlling the loop of the sheet P from the transfer nip portion N1 between the photosensitive drum 1 and the transfer roller 5 to the fixing nip portion N2 of the fixing device 8 with use of the loop amount detecting sensor 18. However, as long as the loop of the sheet P is controlled, the number of rotations of the pressurizing roller 11 may be controlled to achieve a constant behavior of the sheet P.

The fixing entrance guide 20 of the first embodiment is arranged on the fixing film 12 side with respect to the nip line "a" between the fixing film 12 and the pressurizing roller 11. With this, the fixing entrance guide 20 functions to guide the sheet P to the fixing nip portion N2 of the fixing device 8, and also functions to convey the sheet P from the fixing film 12 side to the fixing nip portion N2 to preheat the sheet P before the sheet P enters the fixing nip portion N2, thereby suppressing the fixing explosion phenomenon or improving the fixing performance.

For example, the fixing entrance guide 20 guides the sheet P from the fixing film 12 side to the fixing nip portion N2 of the fixing device 8. At this time, triboelectric charging occurs due to the rubbing between the sheet P and the fixing entrance guide 20. At this time, the fixing entrance guide 20 is charged to a negative polarity due to the triboelectric series with the sheet P. In the first embodiment, the charged amount of the fixing entrance guide 20 is −1,200 V.

The potential of the sheet P after the toner image is transferred from the photosensitive drum 1 onto the sheet P is as follows. In order to attract the toner image from the photosensitive drum 1 to the sheet P, a high transfer bias voltage is applied to the transfer roller 5. Therefore, the sheet P is charged to a positive polarity. In the first embodiment, the charged amount of the sheet P after the transfer is +200 V.

Under a state in which the fixing entrance guide for guiding the sheet P to the fixing device 8 is charged to a negative polarity, the trailing edge of the sheet P, which has passed through the transfer nip portion N1 to become free, flutters, and thus the sheet P charged to a positive polarity is separated from the fixing entrance guide 20. At this time, the separating discharge phenomenon occurs because the potential difference is large between the fixing entrance guide 20 and the sheet P.

In the first embodiment, the potential difference between the charged amount of the fixing entrance guide 20 and the charged amount of the sheet P after the transfer is 1,400 V. The separating discharge phenomenon causes disturbance of the unfixed toner image transferred onto the sheet P, which causes an image defect in a dotted pattern or the like. The phenomenon of the image defect in a dotted pattern or the like remarkably appears as the potential difference between the charged amount of the fixing entrance guide 20 and the charged amount of the sheet P after the transfer becomes larger.

As illustrated in FIG. 1, as the fixing entrance guide 20 is placed closer to the fixing film 12 side with respect to the nip line "a" between the fixing film 12 and the pressurizing roller 11, the sliding frictional force between the sheet P and the fixing entrance guide 20 increases, and hence the triboelectric charging amount increases. Therefore, the potential difference between the charged amount of the fixing entrance guide 20 and the charged amount of the sheet P after the transfer increases, and hence the phenomenon of an image defect in a dotted pattern or the like remarkably appears.

When a high-resistance sheet P is conveyed in a low-temperature and low-humidity environment, the charge generating amount due to the triboelectric charging, which is caused by the sliding against the fixing entrance guide 20, increases. Therefore, the fixing entrance guide 20 has a larger charged amount than that in a normal environment (normal-temperature and normal-humidity environment). For example, in the normal-temperature and normal-humidity environment, the charged amount of the fixing entrance guide 20 is −1,200 V. In contrast, in the low-temperature and low-humidity environment, the charged amount of the fixing entrance guide 20 is −2 kV. Therefore, the potential difference between the charged amount of the fixing entrance guide 20 and the charged amount of the sheet P after the transfer increases.

Therefore, the separating discharge phenomenon tends to become worse as the environment changes toward the low-temperature and low-humidity environment. Further, when the sheet P such as paper is once heated by the fixing device 8 and the moisture contained therein is taken away, such as when the sheet P is subjected to duplex printing, the surface resistance of the sheet P increases.

With this, the charge generating amount increases due to the triboelectric charging between the sheet P and the fixing entrance guide 20. Therefore, the fixing entrance guide 20 is charged due to the conveyance of the sheet P, and the potential difference with respect to the sheet P after the transfer increases. As a result, the image defect in a dotted pattern or the like tends to deteriorate.

For example, in the normal-temperature and normal-humidity environment, the potential difference between the charged amount of the fixing entrance guide 20 and the charged amount of the sheet P after the transfer during simplex printing is −1,200 V. In contrast, in the normal-temperature and normal-humidity environment, the potential difference between the charged amount of the fixing entrance guide 20 and the charged amount of the sheet P after the transfer during duplex printing is −2 kV. Further, in the low-temperature and low-humidity environment, the potential difference between the charged amount of the fixing entrance guide 20 and the charged amount of the sheet P after the transfer during duplex printing is −2,300 V.

In the first embodiment, the transfer bias voltage applied from the transfer bias power source 10*c* to the transfer roller 5 has a positive polarity (first polarity). Therefore, as a DC voltage having a negative polarity, which corresponds to a polarity opposite to that of the transfer bias voltage, a separation bias voltage (−2,750 V) stronger (having a larger voltage value in absolute value) than a voltage for normal charge elimination (−1,200 V) is applied from the separation bias power source 10*d* to the charge eliminating needle 14. With this, the sheet P that is normally charged to a positive polarity (about +200 V) is charged to a negative polarity (about −2 kV). In this manner, the photosensitive drum 1 and the sheet P are electrostatically separated from each other, and the separating discharge phenomenon is prevented between the fixing entrance guide 20 and the sheet P.

A separation bias voltage having a negative polarity, which is a polarity opposite to that of the transfer bias voltage (positive polarity) applied from the transfer bias power source 10*c* to the transfer roller 5, is applied from the separation bias power source 10*d* to the charge eliminating needle 14.

In the first embodiment, the transfer bias voltage applied from the transfer bias power source 10*c* to the transfer roller 5 has a positive polarity (first polarity). Then, as a DC voltage having a negative polarity, which corresponds to a polarity opposite to that of the transfer bias voltage, a separation bias voltage (−2,750 V) stronger (having a larger voltage value in absolute value) than a voltage for normal charge elimination (−1,200 V) is applied from the separation bias power source 10*d* to the charge eliminating needle 14. At this time, the amount of influx between the transfer bias voltage and the separation bias voltage increases. As a result, a risk of occurrence of an image defect due to insufficient transfer increases.

Therefore, a predetermined DC voltage having a polarity opposite to that of toner is applied from the transfer bias power source 10*c* to the transfer roller 5. With this, a voltage value is changed to a larger voltage value in absolute value so as to increase the output of the DC voltage value than the predetermined transfer bias voltage (+1,500 V) used to electrostatically transfer the toner image adhering on the surface of the photosensitive drum 1 onto the sheet P sequentially, as follows. That is, a transfer bias voltage (+1,900 V=1,500 V+400 V) is applied. Each of the transfer bias voltage and the separation bias voltage is changed by the control portion 9 in the same polarity direction. With this, an image defect, due to insufficient output of the transfer bias voltage when the separation bias voltage is increased, is prevented.

Figure 2:
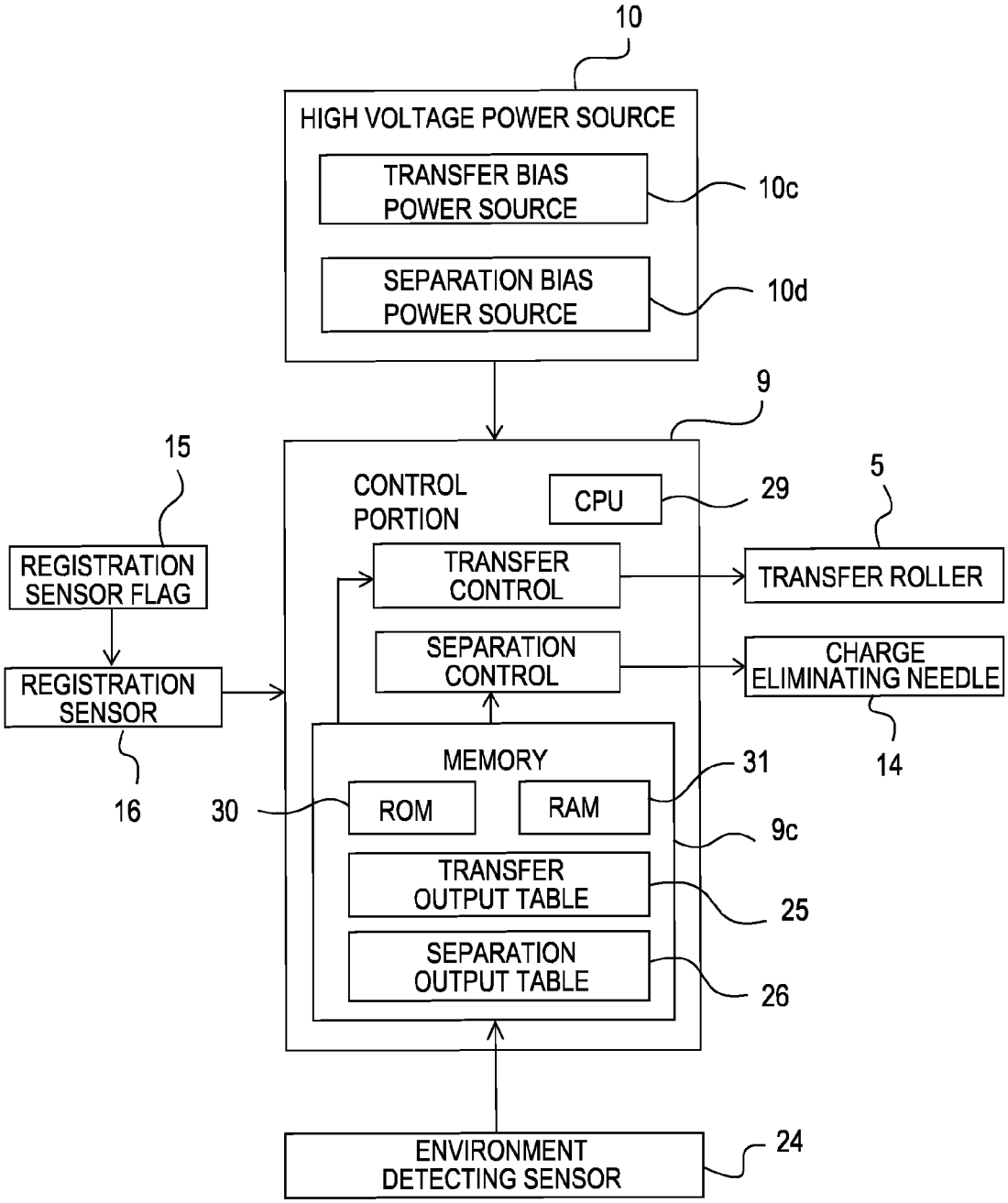
FIG. 2 is a block diagram illustrating a control system of the first embodiment.

FIG. 2 is a block diagram illustrating the control system of the first embodiment. The control portion 9 serving as the controlling unit includes a central processing unit (CPU) 29 configured to perform transfer control and separation control. Further, the memory 9*c* includes a read only memory (ROM) 30. The ROM 30 stores a program or the like corresponding to the control procedure to be described later. The CPU 29 performs control of respective portions while reading out this program.

The memory 9*c* also includes a random access memory (RAM) 31 storing operation data and input data. The CPU 29 performs control with reference to data stored in the RAM 31 based on the above-mentioned program or the like. Further, the control portion 9 is connected to the registration sensor 16 that operates based on the registration sensor flag 15. Further, the control portion 9 is connected to the environment detecting sensor 24. The memory 9*c* of the control portion 9 stores a transfer output table 25 and a separation output table 26.

The high voltage power source 10 includes the transfer bias power source 10*c* and the separation bias power source 10*d*. With reference to the transfer output table 25 stored in the memory 9*c*, the CPU 29 controls the transfer bias power source 10*c* to perform transfer control including control of the transfer bias voltage to be applied to the transfer roller 5. Further, with reference to the separation output table 26 stored in the memory 9*c*, the CPU 29 controls the separation bias power source 10*d* to perform separation control including control of the separation bias voltage to be applied to the charge eliminating needle 14.

Figure 3:
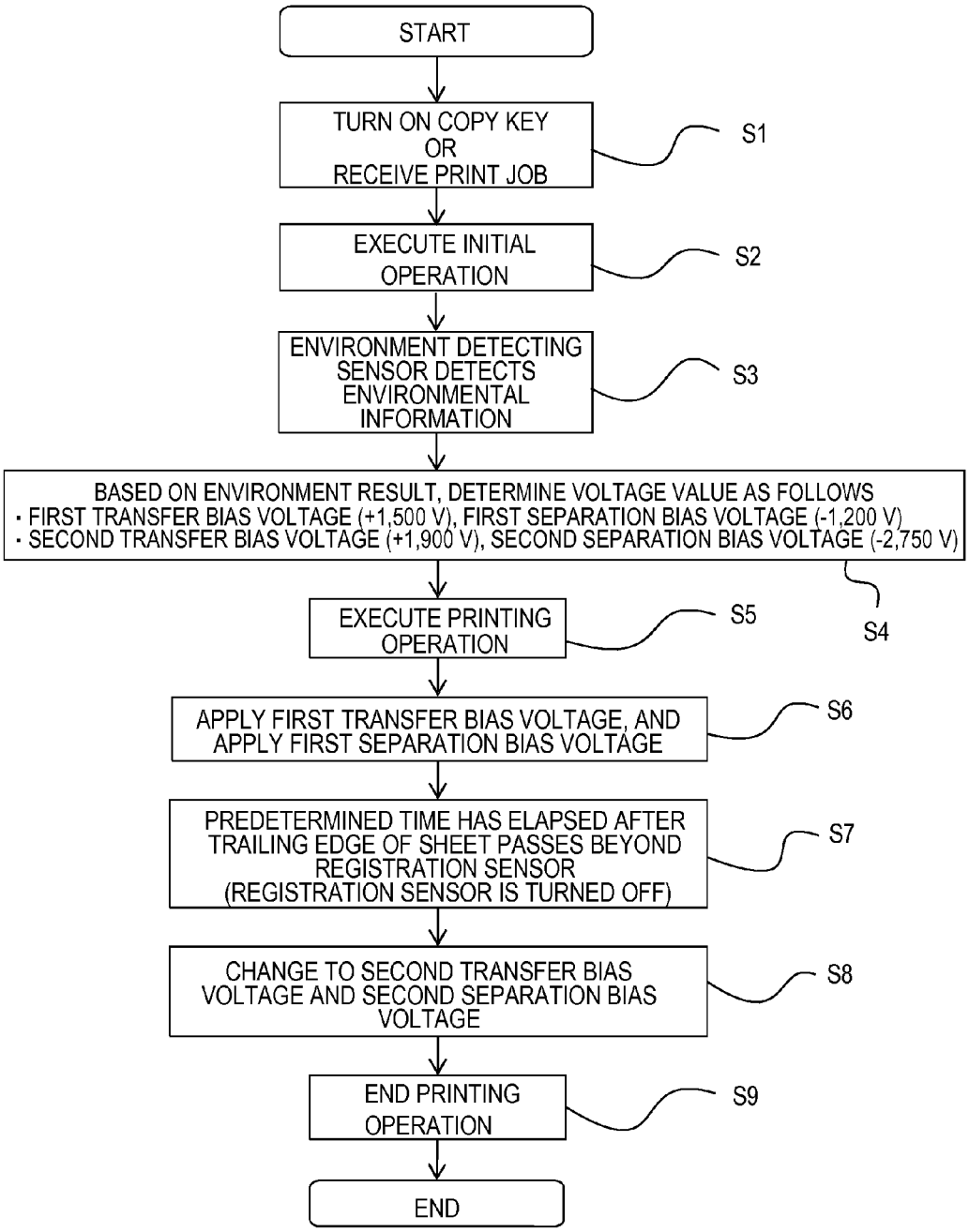
FIG. 3 is a flow chart illustrating a control operation of the first embodiment.

Next, with reference to the flow chart of FIG. 3, the control operation to be executed by the CPU 29 of the first embodiment is described. In Step S1, the user turns on a copy key provided to the image forming apparatus 22. Alternatively, a print job is received.

Next, in Step S2, an initial operation is executed. After that, in Step S3, the environment detecting sensor 24 installed inside the main body of the image forming apparatus 22 detects the environmental information inside the main body of the image forming apparatus 22.

Next, in Step S4, based on the environment result detected by the environment detecting sensor 24, a first transfer bias voltage (+1,500 V), which corresponds to a DC voltage having a polarity opposite to that of toner, is determined. Further, a first separation bias voltage.

(−1,200 V), which corresponds to a DC voltage having the same polarity as that of the toner, is determined. The voltage values are determined with reference to the transfer output table 25 and the separation output table 26, which are stored in advance in the memory 9*c* of the control portion 9 illustrated in FIG. 2.

Further, a second transfer bias voltage (+1,900 V=1,500 V+400 V) that is increased on the polarity side opposite to that of the toner than the first transfer bias voltage (+1,500 V) that is a DC voltage having a polarity opposite to that of the toner image is determined. Further, a second separation bias voltage (−2,750 V=−1,200 V−1,550 V) that is increased on the same polarity side as that of the toner than the first separation bias voltage.

(−1,200 V) that is a DC voltage having the same polarity as that of the toner image is determined.

Then, in FIG. 1, the sheet P is conveyed to press down the registration sensor flag 15. Then, when the registration sensor 16 is turned on, in Step S5, the printing operation is executed. Further, in Step S6, the first transfer bias voltage (+1,500 V) is applied from the transfer bias power source 10*c* to the transfer roller 5. Then, the first separation bias voltage (−1,200 V) is applied from the separation bias power source 10*d* to the charge eliminating needle 14.

After that, the sheet P is further conveyed. In Step S7, when the trailing edge of the sheet P passes beyond the registration sensor flag 15, the registration sensor 16 is turned off. After 460 mm/sec from the time when the registration sensor 16 is turned off, in Step S8, the transfer bias voltage is changed from the first transfer bias voltage (+1,500 V) to the second transfer bias voltage (+1,900 V). After 460 mm/sec from the time when the registration sensor 16 is turned off refers to time when a position of the sheet P inward by 2 mm from the trailing edge is located at the transfer nip portion N1.

Further, in Step S8, at a timing delayed by a time period (60 mm/sec) required for the sheet P to pass from the transfer nip portion N1 to the charge eliminating needle 14, the separation bias voltage is changed from the first separation bias voltage (−1,200 V) to the second separation bias voltage (−2,750 V).

The timing delayed by a time period (60 mm/sec) required for the sheet P to pass from the transfer nip portion N1 to the charge eliminating needle 14 refers to time required to convey the sheet P from the transfer nip portion N1 to the charge eliminating needle 14, that is, refers to time when the position of the sheet P inward by 2 mm from the trailing edge is located at the position of the charge eliminating needle 14.

Based on the position of the trailing edge of the sheet P, the timing to apply the transfer bias voltage from the transfer bias power source 10*c* to the transfer roller 5 and the timing to apply the separation bias voltage from the separation bias power source 10*d* to the charge eliminating needle 14 are changed.

Then, the application of the separation bias voltage from the separation bias power source 10*d* to the charge eliminating needle 14 is continued until the sheet P passes through the transfer nip portion N1. The delivery roller (not shown) delivers the sheet P completely outside the main body of the image forming apparatus 22 to end the printing operation (Step S9).

That is, in the first embodiment, the environment detecting sensor 24 detects the low-temperature and low-humidity environment as the environmental information to be detected. At this time, based on the transfer output table 25 for the transfer bias voltage and the separation output table 26 for the separation bias voltage which are stored in the memory 9*c*, the control portion 9 serving as the controlling unit determines the transfer bias voltage and the separation bias voltage.

Then, at a timing at which the trailing edge of the sheet P is located on the upstream with respect to the transfer nip portion N1 between the photosensitive drum 1 and the transfer roller 5, the transfer bias voltage and the separation bias voltage are changed to the following bias voltages.

Before the trailing edge of the conveyed sheet P passes through the transfer nip portion N1 corresponding to a transfer region in which the transfer roller 5 carries out transfer, the control portion 9 performs the following changes. That is, the control portion 9 changes the first transfer bias voltage (+1,500 V) and the first separation bias voltage (−1,200 V) during transfer of the toner image to larger voltage values, respectively. That is, the first transfer bias voltage and the first separation bias voltage are changed to the second transfer bias voltage (+1,900 V) and the second separation bias voltage (−2,750 V) having larger voltage values in absolute values, respectively.

Figures 4A, 4B:
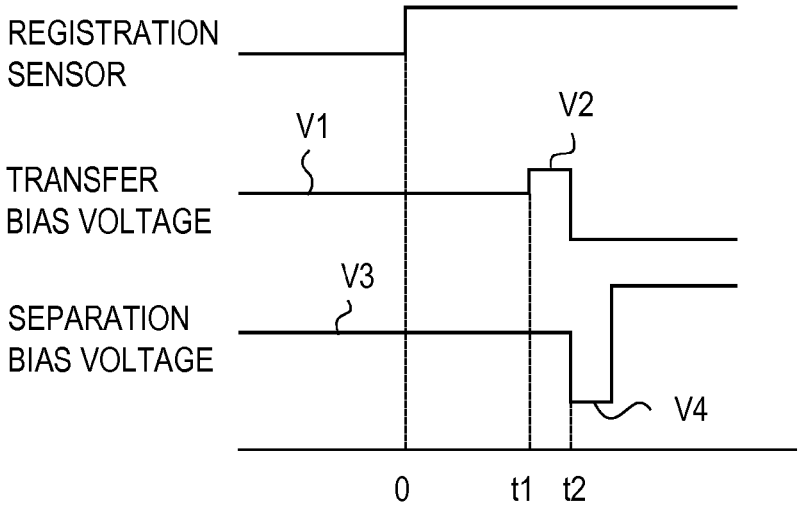
FIG. 4A is a timing chart of transfer bias voltage application and separation bias voltage application of the first embodiment.
FIG. 4B is an output table illustrating a transfer bias voltage and a separation bias voltage in the timing chart of FIG. 4A.

FIG. 4A shows a state of changing the transfer bias voltage and the separation bias voltage so that the absolute values thereof increase at predetermined timings after the registration sensor 16 is turned on.

As shown in FIGS. 4A and 4B, at a predetermined timing t1 after the registration sensor 16 is turned on (time point at which the position of the sheet P inward by mm from the trailing edge reaches the transfer nip portion N1), the voltage value is changed as follows. That is, a transfer bias voltage V1 (1,300 V) is changed to a transfer bias voltage V2 (1,700 V). Further, at a predetermined timing t2 after the registration sensor 16 is turned on (time point at which the position of the sheet P inward by 2 mm from the trailing edge reaches the charge eliminating needle 14), the voltage value is changed as follows. That is, a separation bias voltage V3 (−1,200 V) is changed to a separation bias voltage V4 (−2,750 V).

A comparative example in FIG. 4B shows an example in which the transfer bias voltage is constant at 1,300 V, and the separation bias voltage is constant at −1,200 V.

When the sheets P are continuously subjected to duplex printing, a series of operations represented by Steps S2 to S9 are repeatedly executed.

In other words, the potential of the sheet P in the trailing edge portion of the sheet P to be separated from the fixing entrance guide 20 is set as follows. The transfer bias voltage applied from the transfer roller 5 and the separation bias voltage applied from the charge eliminating needle 14 are simultaneously changed based on the position of the trailing edge of the sheet P. With this, while maintaining the transfer performance of the toner image onto the sheet P, the charged amount of the sheet P is set closer to the charged amount of the fixing entrance guide 20. With this, the potential difference between the fixing entrance guide 20 and the sheet P is decreased, and an image defect due to the separating discharge phenomenon at the trailing edge portion of the sheet P is prevented. With the series of operations described above, it is possible to provide the image forming apparatus 22 in which an image defect in a dotted pattern or the like does not occur and the transfer performance is not reduced.

The transfer bias voltage applied to the transfer roller 5 and the separation bias voltage applied to the charge eliminating needle 14 are set as follows. That is, at a timing at which the trailing edge of the sheet P is located on the upstream with respect to the transfer nip portion N1 between the photosensitive drum 1 and the transfer roller 5, both of the transfer bias voltage and the separation bias voltage are increased (increased in absolute values) than the transfer bias voltage and the separation bias voltage during printing onto the sheet P.

With this, the potential of the sheet P is controlled while maintaining the transfer performance of the toner image onto the sheet P, and thus it is possible to prevent the separating discharge phenomenon from occurring after the sheet P passes through the transfer nip portion N1 between the photosensitive drum 1 and the transfer roller 5. In this manner, a high quality image without an image defect in a dotted pattern or the like can be obtained.

In the first embodiment, the timing to increase both the transfer bias voltage and the separation bias voltage is described based on the position of the sheet P inward by 2 mm from the trailing edge. Besides, it has been confirmed that the effect can be achieved without a problem even when the position is changed in an upstream direction to be inward up to 20 mm from the trailing edge of the sheet P to exceed a trailing edge margin of 10 mm. FIG. 5 shows comparison between the first embodiment and an embodiment described in Japanese Patent Application Laid-Open No. H05-333704. Symbol "○" represents necessity or a satisfactory state, and symbol "x" represents unnecessity or failure.

Second Embodiment

Next, an image forming apparatus according to a second embodiment of the present invention is described with reference to FIGS. 6 and 7. The second embodiment differs from the first embodiment in that the execution of change in high voltage for the trailing edge of the recording material is changed based on the environmental information. Configurations similar to those in the first embodiment are denoted by the same reference symbols, or referred to as the same member name even if the reference symbol differs, and description thereof is omitted.

In a low-temperature and low-humidity environment, when a high-resistance sheet P is conveyed, the charge generating amount due to the triboelectric charging increases, and the charged amount of the fixing entrance guide 20 increases than that in a normal environment. Therefore, the potential difference between the fixing entrance guide 20 and the sheet P subjected to the transfer of the toner image increases.

When the sheet P such as paper is once heated by the fixing device 8 and the moisture contained therein is taken away, such as during duplex printing, the surface resistance of the sheet P increases. At this time, the charge generating amount due to the triboelectric charging between the sheet P and the fixing entrance guide 20 increases.

Therefore, when the environmental information detected by the environment detecting sensor 24 is the low-temperature and low-humidity environment, and the duplex printing is carried out, the fixing entrance guide 20 is in the following state. That is, the charged amount of the fixing entrance guide 20 increases than that when the sheet P is conveyed immediately after the start of use of the image forming apparatus 22, and the potential difference between the fixing entrance guide 20 and the sheet P subjected to the transfer of the toner image increases.

FIG. 6 shows results of comparison between the second embodiment and a comparative example in the surface resistance of the sheet P, the charged amount of the fixing entrance guide 20, the charged amount of the trailing edge of the sheet P, and the potential difference between the fixing entrance guide 20 and the sheet P.

When the potential difference (absolute value) between the fixing entrance guide 20 and the sheet P is 1,500 V or more, a phenomenon of an image defect in a dotted pattern or the like remarkably appears. In view of this, when the result detected by the environment detecting sensor 24 is the low-temperature and low-humidity environment (2.1 g/kg (DA) or less), and in addition, when the high resistance sheet P, such as paper, which has been once heated by the fixing device 8 to lose the moisture contained therein is used, the risk of occurrence of the image defect due to the separating discharge phenomenon increases. In this case, the absolute humidity corresponds to the amount of moisture contained in dry air of 1 kg, and the unit thereof is represented by [g/kg (DA)].

In other words, in the second embodiment, in the low-temperature and low-humidity environment (2.1 g/kg (DA) or less) when printing on the second surface in duplex printing, the fixing entrance guide 20 is charged to a negative polarity by frictioning the fixing entrance guide 20 that guides the sheet P to the fixing device 8 with the sheet P. In view of this, a separation bias voltage having a polarity opposite to that of the transfer bias voltage applied from the transfer bias power source 10*c* to the transfer roller 5 is applied from the separation bias power source 10*d* to the charge eliminating needle 14.

In the second embodiment, the transfer bias voltage applied to the transfer roller 5 has a positive polarity. Then, as a DC voltage having a negative polarity corresponding to the polarity opposite to that of the transfer bias voltage, a separation bias voltage (−2,750 V) stronger (larger in absolute value) than the separation bias voltage for normal charge elimination (−1,200 V) is applied to the charge eliminating needle 14.

With this, the sheet P that is normally charged to a positive polarity (about +200 V) is charged to a negative polarity (about −2 kV). In this manner, the photosensitive drum 1 and the sheet P are electrostatically separated from each other, and the separating discharge phenomenon is prevented between the fixing entrance guide 20 and the sheet P.

However, when the separation bias voltage (−1,550 V) is applied to the charge eliminating needle 14, the amount of influx increases between the transfer bias voltage (+1,500 V) having a positive polarity, which is applied to the transfer roller 5, and a separation bias voltage (−2,750 V) having a negative polarity, which is applied to the charge eliminating needle 14. As a result, a risk of occurrence of an image defect due to insufficient transfer increases.

Therefore, a predetermined DC voltage having a polarity opposite to that of toner is applied to the transfer roller 5 during the separating discharge preventing control in the second embodiment. With this, a second transfer bias voltage (+1,900 V=1,500 V+400 V) is applied, which is increased in DC voltage value than a predetermined first transfer bias voltage (+1,500 V) used for electrostatically transferring the toner image adhering to the photosensitive drum 1 onto the sheet P sequentially. With this, an image defect due to the shortage of the transfer bias voltage is prevented.

Figure 7:
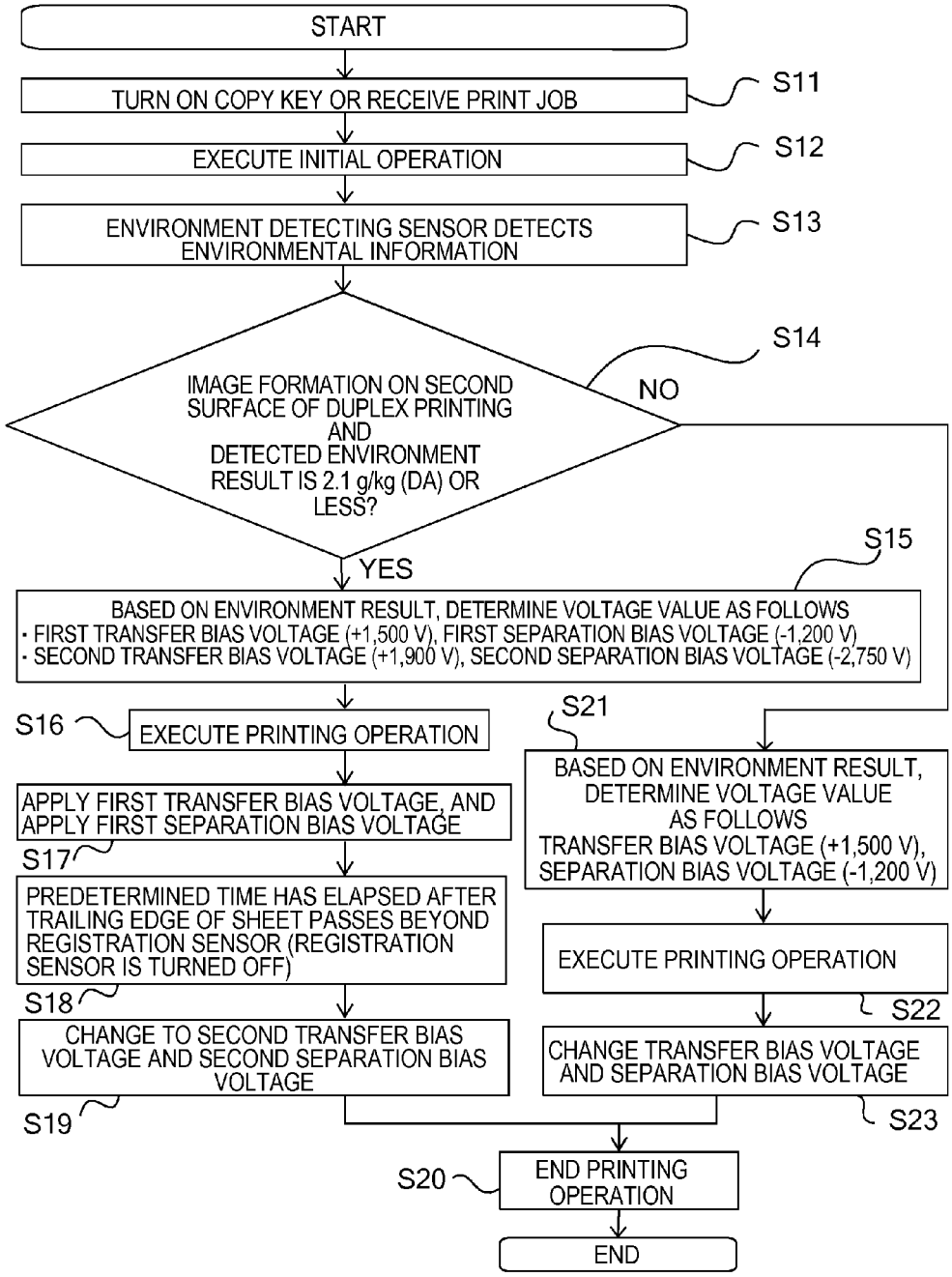
FIG. 7 is a flow chart illustrating a control operation of an image forming apparatus according to a second embodiment of the present invention.

With reference to the flow chart illustrated in FIG. 7, a control operation of the second embodiment is described. In Step S11, the user turns on a copy key, or a print job is received. Then, in Step S12, an initial operation is executed. After that, in Step S13, the environment detecting sensor 24 installed inside the main body of the image forming apparatus 22 detects the environmental information inside the main body of the image forming apparatus 22.

Next, in Step S14, when the environment result detected by the environment detecting sensor 24 is the low-temperature and low-humidity environment (2.1 g/kg (DA) or less), and the duplex printing job is received in Step S11, the processing proceeds to Step S15. In this case, with reference to the transfer output table 25 and the separation output table 26 which are stored in advance in the memory 9*c* of the control portion 9, the first transfer bias voltage (+1,500 V) corresponding to a DC voltage having a polarity opposite to that of toner is determined. Further, the first separation bias voltage (−1,200 V) corresponding to a DC voltage having the same polarity as that of the toner is determined.

Further, the second transfer bias voltage (+1,900 V=1,500 V+400 V) that is increased on the polarity side opposite to that of the toner than the first transfer bias voltage (+1,500 V) that is a DC voltage having a polarity opposite to that of the toner image is determined. Further, the second separation bias voltage (−2,750 V=−1,200 V−1,550 V) that is increased on the same polarity side as that of the toner than the first separation bias voltage.

(−1,200 V) that is a DC voltage having the same polarity as that of the toner image is determined.

When the sheet P illustrated in FIG. 1 is conveyed to press down the registration sensor flag 15 and turn on the registration sensor 16, in Step S16, the printing operation is executed. Then, in Step S17, the first transfer bias voltage (+1,500 V) is applied from the transfer bias power source 10*c* to the transfer roller 5, and further the first separation bias voltage (−1,200 V) is applied from the separation bias power source 10*d* to the charge eliminating needle 14.

After that, in Step S18, when the sheet P is further conveyed so that the trailing edge of the sheet P passes beyond the registration sensor flag 15, the registration sensor 16 is turned off. Then, the environment detecting sensor 24 detects the low-temperature and low-humidity environment as a detection result, and the sheet P is conveyed for the second surface in the duplex printing. Only at this time, in Step S19, after 460 mm/sec from the time when the registration sensor 16 is turned off, the voltage is changed from the first transfer bias voltage (+1,500 V) to the second transfer bias voltage (+1,900 V). In this case, after 460 mm/sec from the time when the registration sensor 16 is turned off refers to time when a position of the sheet P inward by 2 mm from the trailing edge is located at the transfer nip portion N1.

Further, at a timing delayed by a passage time period (60 mm/sec) required for the sheet P conveyed at a predetermined conveyance speed to reach the charge eliminating needle 14 from the transfer nip portion N1 between the transfer roller 5 and the photosensitive drum 1, the following change is performed. That is, the voltage is changed from the first separation bias voltage (−1,200 V) to the second separation bias voltage (−2,750 V).

In this case, the timing delayed by a passage time period (60 mm/sec) required for the sheet P to reach the charge eliminating needle 14 from the transfer nip portion N1 refers to time when the position of the sheet P inward by 2 mm from the trailing edge is located at the position of the charge eliminating needle 14.

The application of the separation bias voltage is continued until the sheet P passes through the transfer nip portion N1 between the transfer roller 5 and the photosensitive drum 1. The delivery roller (not shown) delivers the sheet P completely outside the main body of the image forming apparatus 22 to end the printing operation (Step S20).

In Step S14, when the environment result detected by the environment detecting sensor 24 is not the low-temperature and low-humidity environment (2.1 g/kg (DA) or less), with reference to the transfer output table 25 and the separation output table 26 which are stored in advance in the memory 9*c* of the control portion 9, the transfer bias voltage (+1,500 V) corresponding to a DC voltage having a polarity opposite to that of the toner is determined. Further, the separation bias voltage (−1,200 V) corresponding to a DC voltage having the same polarity as that of the toner is determined.

Then, in Step S22, the printing operation is executed. Then, in Step S23, the transfer bias voltage (+1,500 V) is applied from the transfer bias power source 10*c* to the transfer roller 5. Further, the separation bias voltage (−1,200 V) is applied from the separation bias power source 10*d* to the charge eliminating needle 14. Then, the application of the separation bias voltage is continued until the sheet P passes through the transfer nip portion N1 between the transfer roller 5 and the photosensitive drum 1. Then, the delivery roller (not shown) delivers the sheet P completely outside the main body of the image forming apparatus 22 to end the printing operation (Step S20).

When the sheets P are continuously subjected to duplex printing, the series of operations described above are repeatedly executed. With the series of operations described above, it is possible to provide the image forming apparatus 22 in which an image defect in a dotted pattern or the like does not occur and the transfer performance is not reduced.

In the second embodiment, both of the transfer bias voltage and the separation bias voltage are changed only when the environment detecting sensor 24 detects the low-temperature and low-humidity environment and the printing for the second surface is carried out in duplex printing.

Alternatively, regardless of whether or not the printing is carried out for the second surface in duplex printing or regardless of the environment detection result, both of the transfer bias voltage and the separation bias voltage may be changed only when the sheet P is detected to have high resistance. Alternatively, both of the transfer bias voltage and the separation bias voltage may be changed only when the environment detecting sensor 24 detects the low-temperature and low-humidity environment. Other configurations are similar to those in the first embodiment, and effects similar thereto can be obtained.

In the above mentioned embodiments, the transfer bias voltage and the separation bias voltage are changed to have voltage values, which are larger than that of the transfer bias voltage and the separation bias voltage in the image formation, before the trailing edge of the recording material passes through the transfer region, in order to adjust the potential of the trailing edge. However, a method for adjusting the potential of the trailing edge of the recording material is not limited to the above mentioned applying of the transfer bias voltage or the separation bias voltage. It may be a method in which a potential applying unit applies potential to the trailing edge of the recording material until the recording material, which has the toner image transferred thereto and which is separated from the image bearing member, is conveyed to the fixing entrance guide. As the potential applying unit, a charging roller or a corona discharger is disposed between a separate region (a region where the recording material, onto which the toner image has been transferred in the transfer region, is separated from the image bearing member) and the fixing entrance guide. A bias voltage is applied to the potential applying unit when the trailing edge of the recording material is conveyed. In a case that the potential difference between the trailing edge of the recording material and the fixing entrance guide is set by applying the potential with the potential applying unit so as to prevent discharge between the trailing edge and the fixing entrance guide, the discharge phenomenon does not occur.

Furthermore, if the potential of the trailing edge of the recording material approximates to the potential of the guide (the fixing entrance guide) on which the recording material slides, the discharge phenomenon between the trailing edge and the guide does not occur. Therefore, only the separation bias voltage may be changed to have voltage values, which is larger than that of the separation bias voltage in the image formation, before the trailing edge of the recording material passes through the separate region. Thereby, the potential of the trailing edge is adjusted. In this case, the bias voltage is changed so that the potential difference between the trailing edge and the guide is set so as to prevent discharge between the trailing edge and the guide.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269187, filed Dec. 26, 2013 which is hereby incorporated by reference herein in its entirety.

What is claimed is:

1. An image forming apparatus, comprising:

a transfer unit configured to transfer a toner image on an image bearing member onto a recording material which has been conveyed to a transfer region;

a transfer bias voltage applying unit configured to apply a transfer bias voltage to the transfer unit;

a separating unit configured to cause the recording material to separate from the image bearing member after the toner image is transferred from the image bearing member onto the recording material;

a separation bias voltage applying unit configured to apply a separation bias voltage to the separating unit; and a controlling unit configured to change the transfer bias voltage and the separation bias voltage to have larger voltage values before a trailing edge of the recording material passes through the transfer region.

2. An image forming apparatus according to claim 1, wherein the transfer bias voltage has a first polarity, and wherein the separation bias voltage has a second polarity opposite to the first polarity.

3. An image forming apparatus according to claim 1, wherein the controlling unit changes a voltage value so that the separation bias voltage has a larger voltage value than the transfer bias voltage.

4. An image forming apparatus according to claim 1, wherein the controlling unit changes the transfer bias voltage before changing the separation bias voltage.

5. An image forming apparatus according to claim 1, further comprising an environment detecting unit configured to detect environmental information, wherein the controlling unit changes the transfer bias voltage and the separation bias voltage when the environment detecting unit detects predetermined environmental information.

6. An image forming apparatus according to claim 1, wherein the image forming apparatus performs image formation on a first surface of the recording material and then performs image formation on a second surface of the recording material, and wherein the controlling unit changes the transfer bias voltage and the separation bias voltage when performing the image formation on the second surface.

7. An image forming apparatus according to claim 1, further comprising a fixing unit configured to fix the toner image having been transferred onto the recording material to the recording material, wherein the fixing unit comprises:

a fixing rotary member having a heat generator;

a pressing rotary member pressing the fixing rotary member; and a fixing entrance guide guiding the recording material to a nip portion between the fixing rotary member and the pressing rotary member, and wherein a leading end portion of the fixing entrance guide which guides the recording material is located on the fixing rotary member side with respect to a nip line at the nip portion.

8. An image forming apparatus, comprising:

a transfer unit configured to transfer a toner image on an image bearing member onto a recording material which has been conveyed to a transfer region;

a guide at least contacting with the recording material to be guided and guiding the recording material, the guide provided downstream from the transfer region; and a potential applying unit configured to apply a predetermined potential such that a potential difference between a trailing edge of the recording material and the guide is set so as to prevent discharge between the trailing edge and the guide, the potential applying unit applying the potential before the trailing edge of the recording material passes through the transfer region.

9. An image forming apparatus according to claim 8, further comprising an environment detecting unit configured to detect environmental information, wherein the controlling unit causes the potential applying unit to apply the potential when the environment detecting unit detects predetermined environmental information.

10. An image forming apparatus according to claim 8, wherein the image forming apparatus performs image formation on a first surface of the recording material and then performs image formation on a second surface of the recording material, and wherein the controlling unit causes the potential applying unit to apply the potential when performing the image formation on the second surface.

11. An image forming apparatus, comprising:

a separating unit configured to cause a recording material to separate from an image bearing member after a toner image is transferred from the image bearing member onto the recording material;

a separation bias voltage applying unit configured to apply a separation bias voltage to the separating unit;

a guide at least contacting with the recording material to be guided and guiding the recording material, the guide provided downstream from a region in which the recording material is separated; and a controlling unit configured to change the separation bias voltage to have a larger voltage value before a trailing edge of the recording material passes through the region so that a potential difference between the trailing edge and the guide is set so as to prevent discharge between the trailing edge and the guide.

12. An image forming apparatus according to claim 11, further comprising an environment detecting unit configured to detect environmental information, wherein the controlling unit changes the separation bias voltage when the environment detecting unit detects predetermined environmental information.

13. An image forming apparatus according to claim 11, wherein the image forming apparatus performs image formation on a first surface of the recording material and then performs image formation on a second surface of the recording material, and wherein the controlling unit changes the separation bias voltage when performing the image formation on the second surface.

* * * * *